US005485965A

United States Patent [19]

Hostettler et al.

[11] Patent Number: 5,485,965

[45] **Date of Patent: *Jan. 23, 1996**

[54] AUTOMATIC PRODUCT FEED AND METHOD FOR CONTROLLING A MILLING ROLLER MILL

[75] Inventors: Rene Hostettler, Sirnach; Ernst Maechler, Uzwil, both of Switzerland

[73] Assignee: Buehler AG, Switzerland

[ * ] Notice: The term of this patent shall not extend beyond the expiration date of the Pat. No. 5,341,995.

[21] Appl. No.: 335,980

[22] Filed: Nov. 4, 1994

Related U.S. Application Data

[63] Continuation of Ser. No. 910,187, Aug. 13, 1992, Pat. No. 5,361,995.

[30] Foreign Application Priority Data

Dec. 12, 1990 [CH] Switzerland ..... 3931/90

[51] Int. Cl.[6] ..... B02C 25/00

[52] U.S. Cl. ..... 241/29; 241/30; 241/36; 241/37; 241/159; 241/231; 241/233

[58] Field of Search ..... 241/29, 30, 36, 241/37, 159, 231, 232, 233

[56] References Cited

U.S. PATENT DOCUMENTS

| | | | |
|---|---|---|---|
| 4,442,980 | 4/1984 | Oetiker et al. | 241/34 |
| 4,881,689 | 11/1989 | Lippuner et al. | 241/37 X |
| 5,361,995 | 11/1994 | Hostettler et al. | 241/29 |

*Primary Examiner*—Frances Han

*Attorney, Agent, or Firm*—Finnegan, Henderson, Farabow, Garrett & Dunner

[57] ABSTRACT

The invention proposes a novel automatic product feed in which an analog signal is formed and at least one other digital signal which is adjustable independently of the analog signal is generated and used for the automatic product feed for supervising the product feed functions by a mechanical probe (8) in the product flow. In this way, all previously known controlling and regulating functions can be realized with a minimum of electronics or at the highest level of computer control as a function of the product feed or for optimizing the grinding conditions, possibly with externally initiated digital signals for various stage adjustments and with the use of very simple automatic component means. The invention further proposes a corresponding method for grinding with a milling roller mill (1).

22 Claims, 7 Drawing Sheets

9
31
8
30
34
1
35
LED 6
LED1
LED3
36
32
POT 2
33
AUTOM.
0
MAN.
max
37
21
24V DC
38
3- Netz
380 V
400 V
415 V
440 V
460 V
39
M
3~
0 55 kW
380 V 32
9
35
31
24V
34
32
39
P
M
3
43
Netz
FU
38
36
40
41
42

AUTOMATIC PRODUCT FEED AND METHOD FOR CONTROLLING A MILLING ROLLER MILL

This is a continuation of application Ser. No. 07/910,187, filed Aug. 13, 1992 now U.S. Pat. No. 5,361,995.

TECHNICAL FIELD

The invention is directed to an automatic product feed for a milling roller mill having a mechanical sensor, a product feed device with adjustable drive means for the feed rolls, as well as engaging and disengaging means for the grinding rolls, and to a method for controlling the grinding in a milling roller mill.

BACKGROUND ART

Strictly defined general conditions must be met for regulating the product feed in a milling roller mill. They are:

- a uniform product distribution over the entire length of the grinding rolls
- the amount of product flowing into the roller mill must be processed within a bandwidth and metered to the grinding rolls while compensating for temporary feed fluctuations as far as possible;
- during an interruption in the product feed to the roller mill, the product feed to the grinding rolls must be stopped with minimum delay and the grinding rolls must be moved apart simultaneously.

With respect to apparatus, various basic elements such as distributing rolls and feed rolls as well as a mechanical probe as sensor for precision regulation of the flow to the grinding rolls have been used successfully for decades. In principle, the momentary adjustment of the amount of product flowing into the grinding rolls can be effected in two ways: by regulating the-rate of rotation or speed of the feed rolls or by regulating the metering gap between a proportioning slide and the feed roll which is also known as segment distribution.

Both arrangements, i.e. speed regulation and segment distribution, are currently practiced.

An example of speed regulation is described in DE-GM No. 86 14 505 and has proven very successful for some applications. However, speed regulation is not as widely used as segment distribution. A regulation of the metering gap is disclosed in EP-PS 38 054, likewise by the present Applicant. When the product to be metered has a flour-like or gritty quality, segment distribution is preferred in practice by the majority of millers. On the other hand, speed regulation has often proved superior to segment distribution in the case of flaky products as in the metering of break, e.g. prior to the second grinding passage in the mill.

The problem which now arises consists in the fact that it must first be determined in principle for every roller mill which concept to install for regulating the feed. A subsequent conversion is often not carried out and thus an absence of optimal feed regulation may recur repeatedly in individual grinding passages.

The grinding process is acknowledged as the core of every mill. Therefore, the quality of the grinding is influenced by a number of parameters. Special importance is attached to the regulation of the product feed to the grinding rolls and to trouble-free operation of the elements required for this. The degree of automation in a modern mill has already reached a particularly high level. A further increase in automation is demanded, not least of all, to ensure quality, at least to the extent that the parameters already presently influenced by hardware technology can be exploited to achieve even greater perfection so as to enable easier access through human intervention and management of the process.

Significantly, an actual conflict of goals can be discerned precisely in regard to the roller mill. This is caused in part by prejudices of an almost ideological character, even in technical circles. Some say that mechanics are now out of date, that modern techniques such as electronics or sensor technology, e.g. optical, capacitive, infrared measuring technology, are superior and more advantageous since electrical/electronic signals are generated immediately. Many trained specialists still attach an almost mystical significance to computer technology accompanied by a strong reliance or euphoric acceptance. As a result, a great number of solutions are offered, each of which, without exception, has achieved only partial acceptance.

DISCLOSURE OF THE INVENTION

It is the object of the present invention to alleviate these disadvantages, at least in part, so as to provide a solution with or without overriding control and in particular to offer the possibility of immediate or subsequent integration in an overriding computer control without expensive conversions.

The device according to the invention is characterized in that it includes a first mechanical signal transmitter for a digital signal and a second mechanical signal transmitter for an analog signal.

Contrary to initial objections that the novel inventive idea would also not contribute any advances, it was soon shown to the surprise of all participants that at least three positive effects were produced simultaneously by selecting two different signal transmitters proceeding from a mechanical sensor:

- a mechanical arrangement is still the most inexpensive of all sensor technologies.
- a mechanical arrangement is more reliable and requires no specialized technical background for handling.
- a mechanical arrangement always has frictional forces in every movement.

However, it has now been shown that the friction brings about a natural damping, particularly for the analog signal, and an outstanding stabilizing effect for the regulation of the product feed results without cost (as for corresponding electronic damping). The greatest unexpected advantage, the core of the novel invention as it were, came from the possibility which it provides for a great number of different methods for solving the problem, whether this consists in that, building upon this foundation, parts of arrangements which are known per se can be controlled and regulated or in that all levels of automation, up to the highest, are equally realizable or can even be installed subsequently. It is precisely this last aspect that has proven to be of increasing important for the foreseeable future because, with good maintenance, a mill is still expected to operate economically for as long as several decades, whereas a life expectancy of 7 to 10 years is an established fact for many parts in modern computer technology.

The novel invention allows a large number of particularly preferred constructions. Thus, the speed of the feed roll can be regulated via the analog signal and engagement and disengagement can be controlled via the digital signal. This division has the particular advantage that practice-related adjustments can be implemented independently of the regulation of the product feed and engagement and disengagement. Each function can be comprehended and supervised in itself. The drive means or a drive motor for the feed roll can be regulated in a continuous manner by the analog signal via an electrical converter unit.

Another formulation of the solution consists in that the analog signal is associated with the regulation of a product feed slide and the digital signal is associated with the engagement and disengagement. The regulation of the product feed slide (segment distribution) can be effected corresponding to EP-PS No. 38 054. In so doing, the mechanically movable sensor is preferably constructed, in a manner known per se, as a probe (e.g. christmas tree or perforated plate) extending in the direction of the product flow to be moved accompanied by spring tension, and the signal transmitter is constructed as a contact element moved by the sensor. A contact element, as signal transmitter for the analog signal or for the digital signal, is associated with the probe in each instance, preferably at an outer end of the roller mill. A proximity switch for converting the mechanical signal into an analog electrical signal is associated with the signal transmitter for the analog signal, and a contact switch of an electrical valve for controlling the engagement and disengagement can be associated with the signal transmitter for the digital signal.

In another construction idea, a voltage transformer unit and a current transformer unit are directly associated with the signal transmitter for the analog signal and integrated in the roller mill. A frequency converter unit for regulating at least two, or a plurality of, feed rolls is preferably arranged at a distance from the roller mill. In another construction idea, the drive motor is flanged directly on a gear unit for reversing the direction of rotation of the feed roll as well as of a distributing roll arranged parallel thereto. To this end, the rotational direction reversing gear unit has a reduction gear ratio of 1:5 to 1:20, preferably approximately 1:10, and the reduction and reversing gear unit can be formed from only three pairs of toothed wheels.

In another especially advantageous construction idea, an adjusting gear unit and a control unit for selecting different speed stages of the feed rolls, and the analog signal for regulating a product feed slide are associated with the drive motor and the engagement and disengagement is controlled via the digital signal.

The invention is further directed to an automatic product feed for a milling roller mill with a mechanical sensor, a product feed device and means for regulating the product feed, wherein an analog signal can be generated via the sensor and a mechanical signal transmitter and further a control and storage unit is associated with the automatic product feed for different positions of an adjusting device.

Preferably, either the opening position of a feed segment is regulated via the analog signal corresponding to the amount of product fed to the roller mill and various speed stages of the feed roll are adjusted via the control and feed unit, or the speed of the feed rolls is regulated via the analog signal corresponding to the amount of product fed to the roller mill and various positions of a feed segment are adjusted via the control and storage unit. In either case a digital signal can be generated from the analog signal, e.g. via limiting value switches, and the engagement and disengagement can be controlled by means of this digital signal.

In every case it is possible to direct an electrical signal through two digital switching elements connected in series and to utilize it only then as an analog signal. The novel invention allows the use of a control unit and storage and computing means in coordination with a control signal for adjusting the grinding gap according to a program which can be determined beforehand.

The invention is further directed to a novel method for controlling the grinding of a milling roller mill which includes an adjusting device and an engaging and disengaging arrangement for the grinding rolls and a product feed to the grinding rolls which is regulated via a product flow sensor, which method is characterized in that an analog signal is generated via a mechanical sensor which regulates as a function of the amount of product fed to the roller mill, and further at least one independently adjustable digital signal is generated which controls either the engagement and disengagement of the grinding rolls or various basic adjustments of the product feed as a function of overriding parameters (mill output, product quality).

The novel invention is the first to show that the generation of an analog signal and a digital signal which can be adjusted as a function of the latter permits the greatest possible freedom in selecting the manner in which the grinding is influenced and optimal grinding conditions are accordingly made possible for the first time for every case of application via the parameters involved in this application. In particular, every function to the lowest possible level can now be ensured autonomously using simple, inexpensive means.

On the one hand, this concerns the regulation of the amount of product engagement and disengagement, and on the other hand various basic settings for the product feed, according to which the product feed is regulated, can be selected with little expenditure by manual control or by computing and storage means.

In a particularly preferred manner two digital signals are generated, wherein a first digital signal from the mechanical sensor controls the engagement and disengagement of the grinding rolls as a function of the product flow and a second digital signal generated by an independent control unit determines basic adjustments of the product feed.

In this way, depending on the type of product, a determined rate of rotation for the feed roll can be preselected or adjusted at any time in the event of a change of product. Or a basic adjustment can be selected, or adjusted when the product is changed, for the segment or the metering gap. The product feed is regulated in every case autonomously or automatically via the analog signal generated by the mechanical sensor.

This novel solution is particularly advantageous for installations with a high degree of automation. It can be provided that the control unit contains storage and computing means and can be used in coordination with a control signal for the grinding gap adjustment according to a program which can be fixed beforehand.

Not only are the two basic possibilities automated in this way, but each can be optimized in its own way.

An optimal feed roll speed can be adjusted, depending on grinding conditions, in the regulation of the amount of product by regulating the segment approximately in accordance with EP-PS 38 054 via a pneumatic regulation of the metering gap.

An optimal value can be adjusted for the metering gap by means of a digital signal of a control unit in regulating the product amount by means of regulating the feed roll speed according to DE-GM 86 14 505.

Thus, not only can the best regulation of the product be determined, wherein the most favorable ratios for the product discharge of the feed rolls are adjustable in every case, but also a stabilizing effect can accordingly be achieved for the grinding as a whole, since the more uniform the product feed for every roller mill, the more stable the grinding as a whole.

The invention is explained in more detail in the following with reference to a number of embodiment examples.

BRIEF DESCRIPTION OF THE INVENTION

MODES OF CARRYING OUT THE INVENTION

Figure 1:
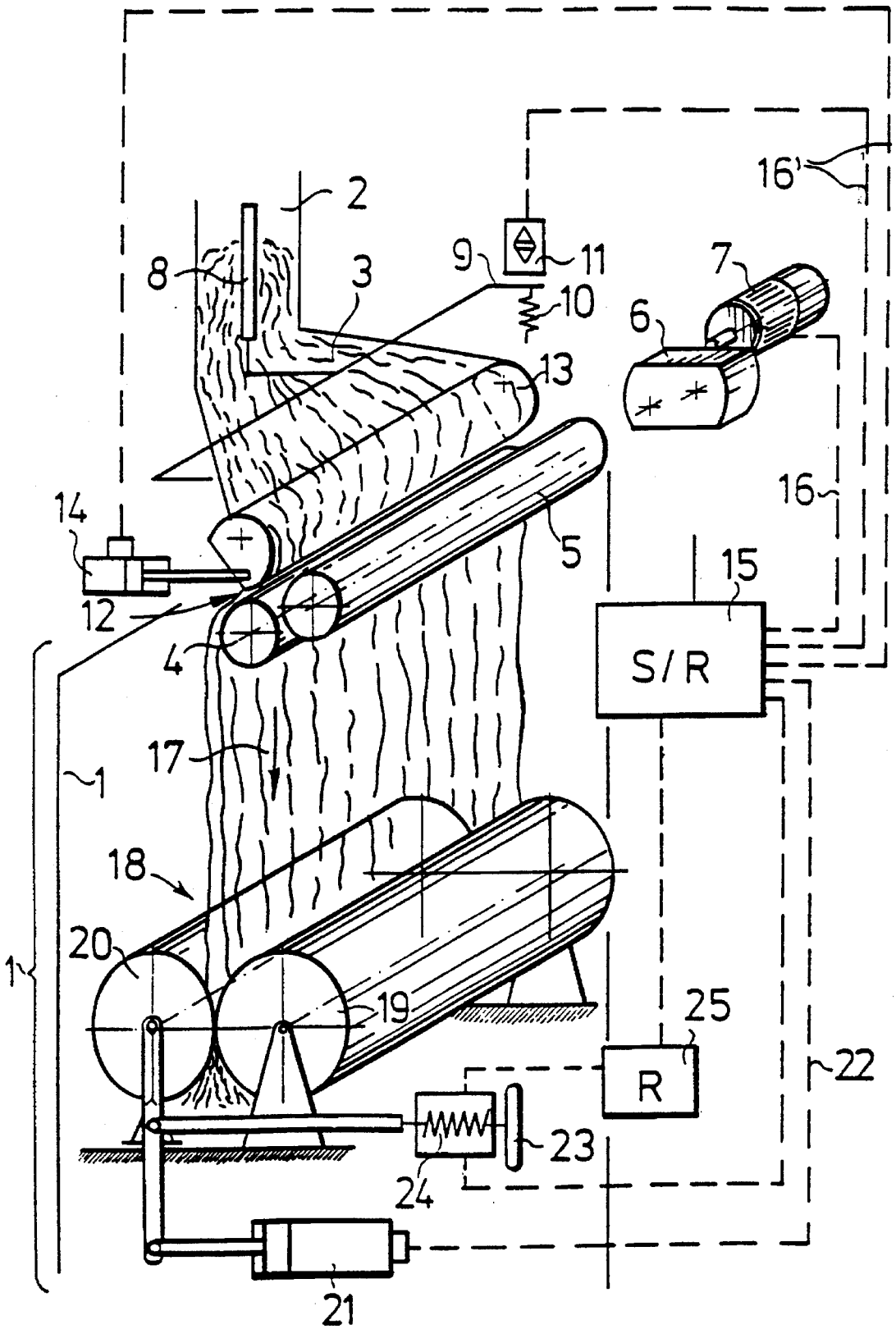
FIG. 1 shows the basic elements for the grinding process in a milling roller mill in a schematic manner.

Reference is made in the following to FIG. 1 which shows a milling roller mill 1 which is normally constructed in a two-fold manner, but only one half of which is shown. The supply of product is effected via a feed cylinder 2 in a product feed space 3 whose lower portion contains a distributing roll 4 and a feed roll 5 which can be made to rotate in the same direction via a gear unit 6 and drive means 7.

A mechanical sensor 8 which is directly connected with a mechanical signal transmitter 9 in an articulated manner is located in the feed cylinder 2. The sensor 8 is held in its highest position by a tension field 10 in the absence of product flow. The flowing product presses the sensor 8 down and the signal transmitter 9 executes an analogous movement and transmits an analog signal, known per se, to a converter unit 11. A feed gap 12 is formed by a segment 13, a segment distributing device 14 being shown schematically in addition. FIG. 1 shows the two basic possibilities whereby either the speed of the feed roll 5 or the position of the feed segment 13 is influenced based upon the signal of the sensor 8 and a converter device (S/R) 15 via connections 16 and 16', respectively, shown in dashes.

The product discharged in the feed roll 6 is fed to a grinding roll pair 18 corresponding to arrow 17. The grinding roll pair includes a fixed roll 19 and a loose roll 20. An engaging and disengaging arrangement 21 which is controlled via a control line 22 as a function of a control signal of the sensor 8 is associated with the loose roll 20. Further, a flour gap adjusting device 23 is associated with the loose roll 20 and can be adjusted manually if necessary or via a motor 24 and an electronic storage/computer unit 25 as a function of either the specific grinding work or the quality of the ground product, or as a function of the product output of the roller mill 1.

Figure 2:
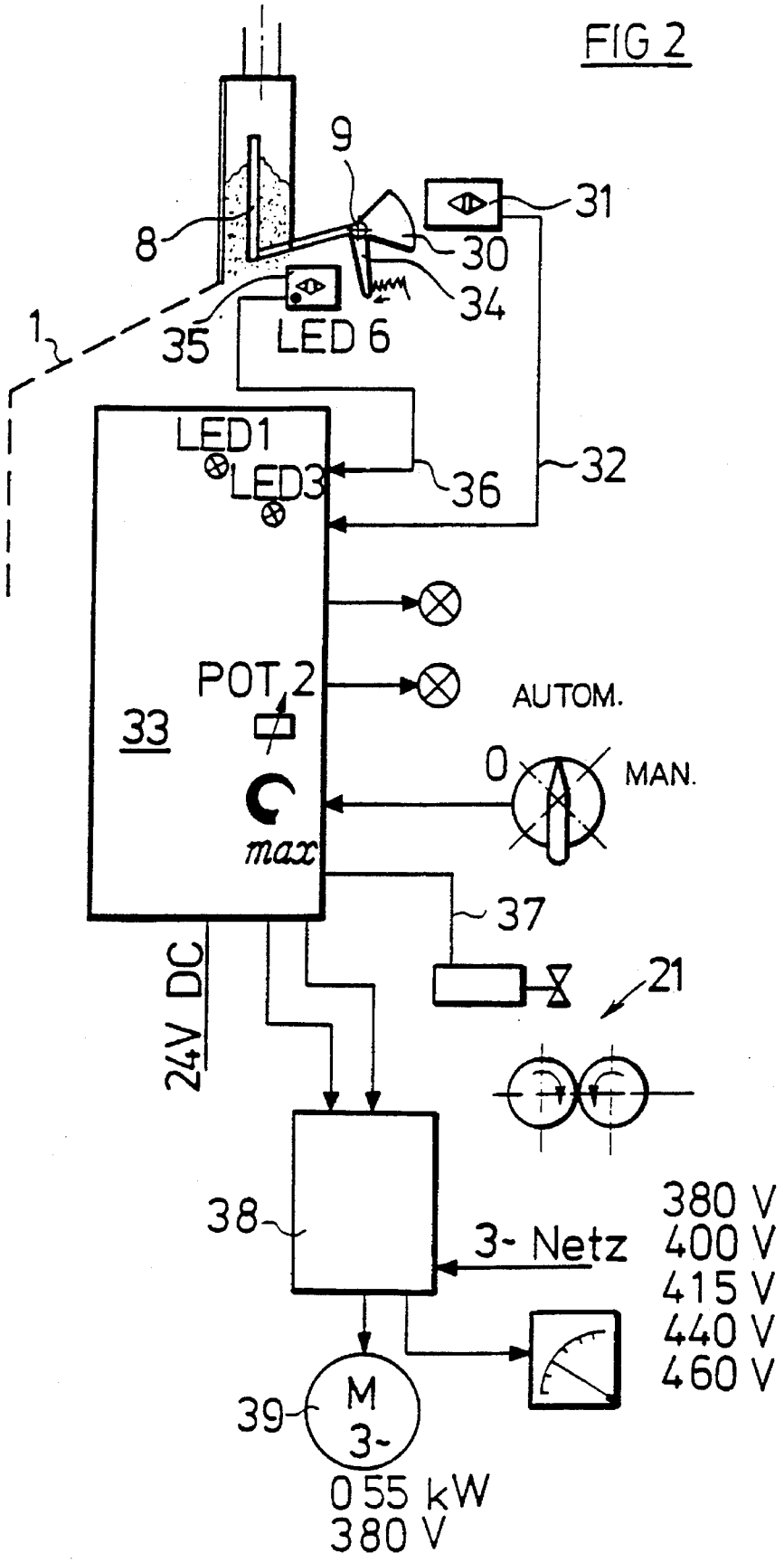
FIG. 2 shows an example with analog signal converter and digital contact switch.

FIG. 2 shows a preferred construction of FIG. 1 with additional details with respect to the control and regulating elements. Two signal transmitters are shown, a signal transmitter 9 for the analog signal which is generated by the movement or position of a cam disk 30 and is transmitted via a control line to evaluating electronics 33 as an electric analog voltage signal by means of an analog signal converter 31; and a second signal transmitter 34 for a digital signal which is likewise transferred, via a contact switch 35 and a control line 36, to the evaluating electronics 33 from which a digital signal is transmitted via a control line 37 to the engaging and disengaging arrangement 21. The analog signal is converted in a frequency converter 38 directly for a drive motor 39 by which the speed of the feed roll 5 is regulated.

Figure 3:
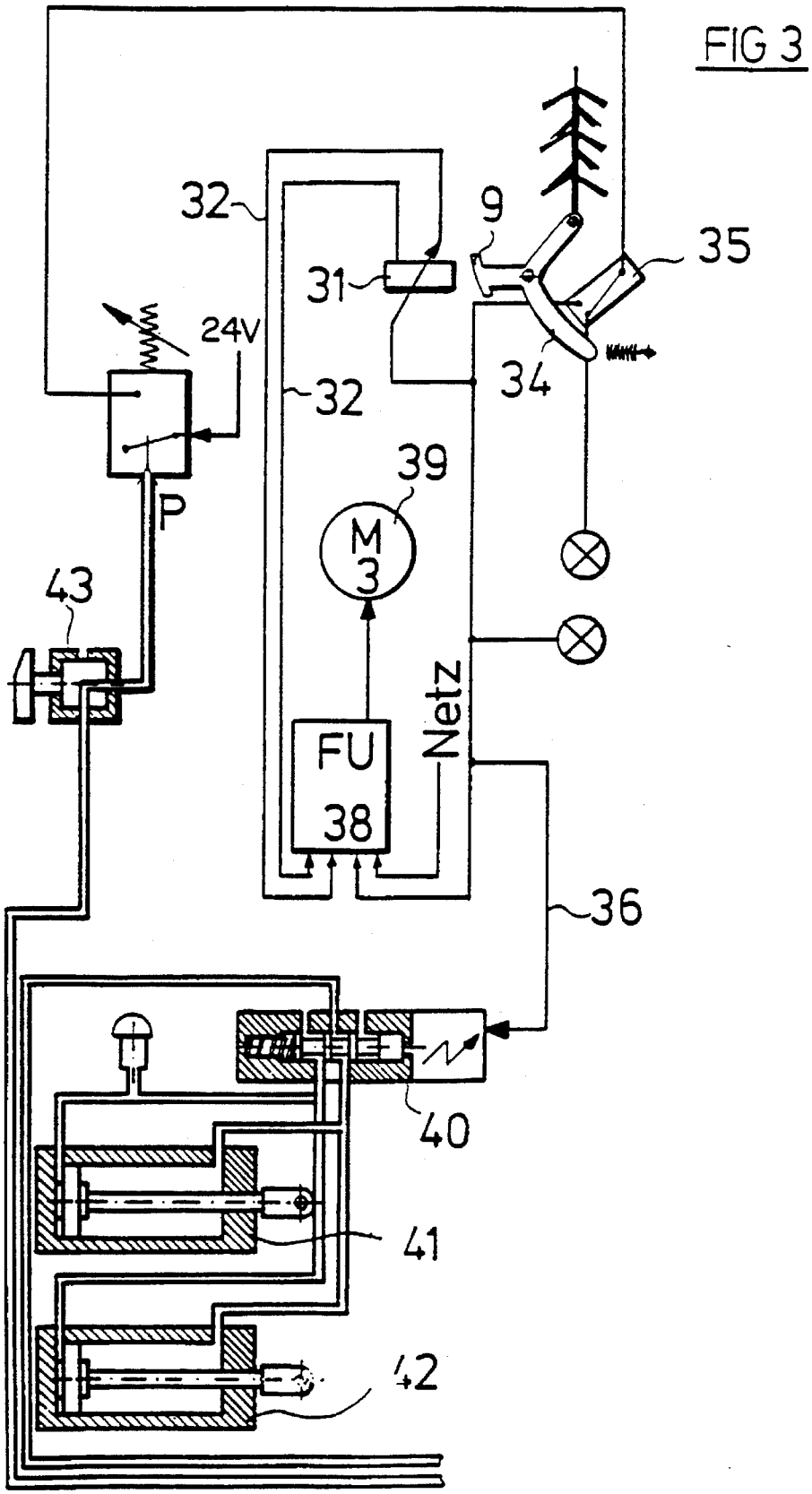
FIG. 3 shows a special embodiment form of FIG. 1 with an electropneumatic valve for the engagement and disengagement of the grading roll.

FIG. 3 shows another construction possibility in a somewhat simplified construction. The analog signal can be controlled by the analog signal converter 31 via the digital signal for special operating positions. The digital signal directly controls an electropneumatic valve 40 which controls two pneumatic cylinders 41 and 42 for engaging and disengaging the grinding rolls. Various basic positions (manual operation/automatic operation, etc.) can be selected on site via a manual switch for desired operating states by supplying compressed air.

Figure 4:
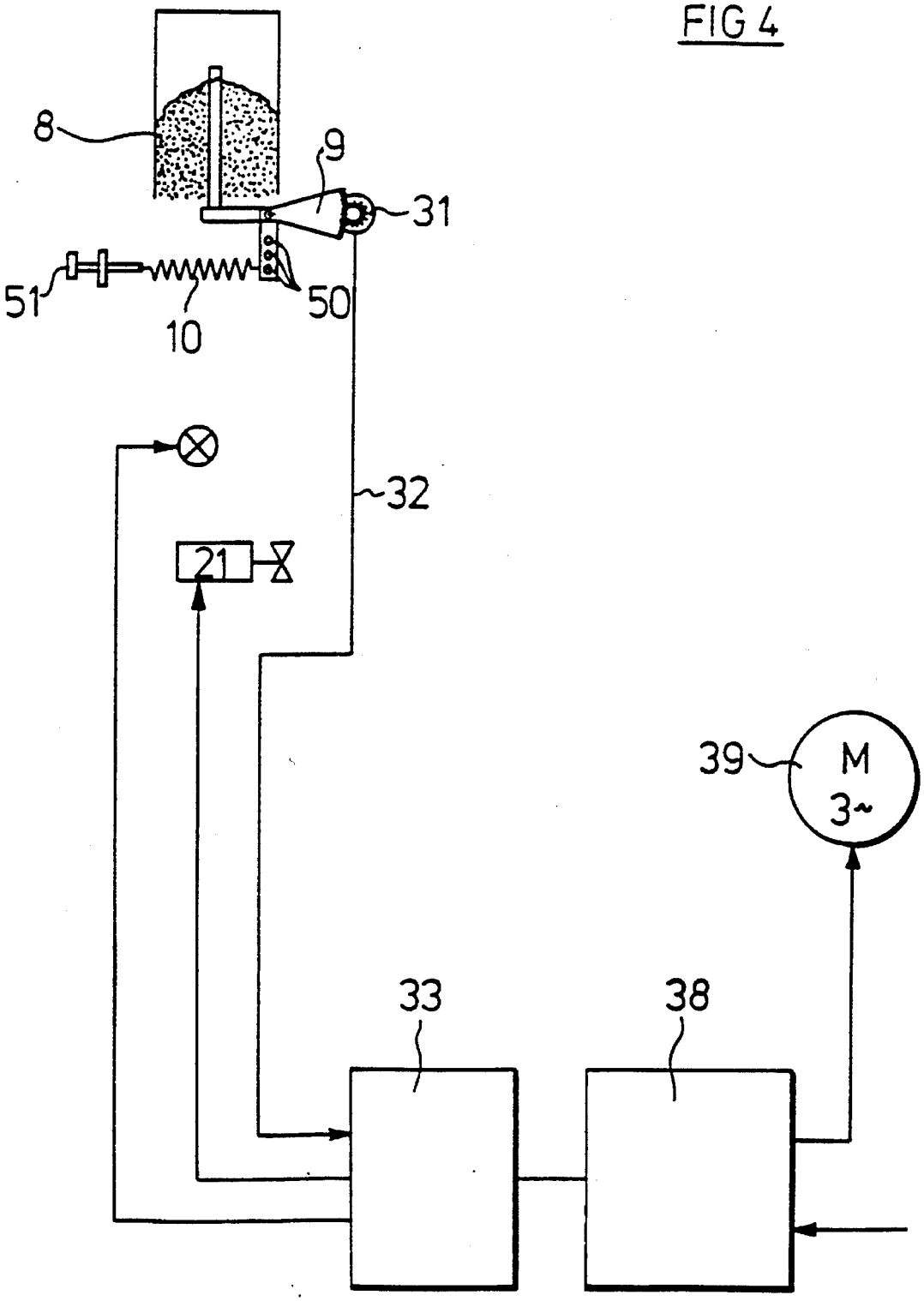
FIG. 4 shows the generation of a mechanical-electrical converter unit with a rotary potentiometer in a schematic manner.

FIG. 4 shows an even more simplified schematic view of the processing of the analog signal, in this case converted by a rotary potentiometer, and shows the conversion of a mechanical analog signal into an electrical analog signal. The tension spring 10 can be arranged in various positions and its tension varied via a tensioning screw 51 depending on the specific product quality and flow conditions.

Figure 5:
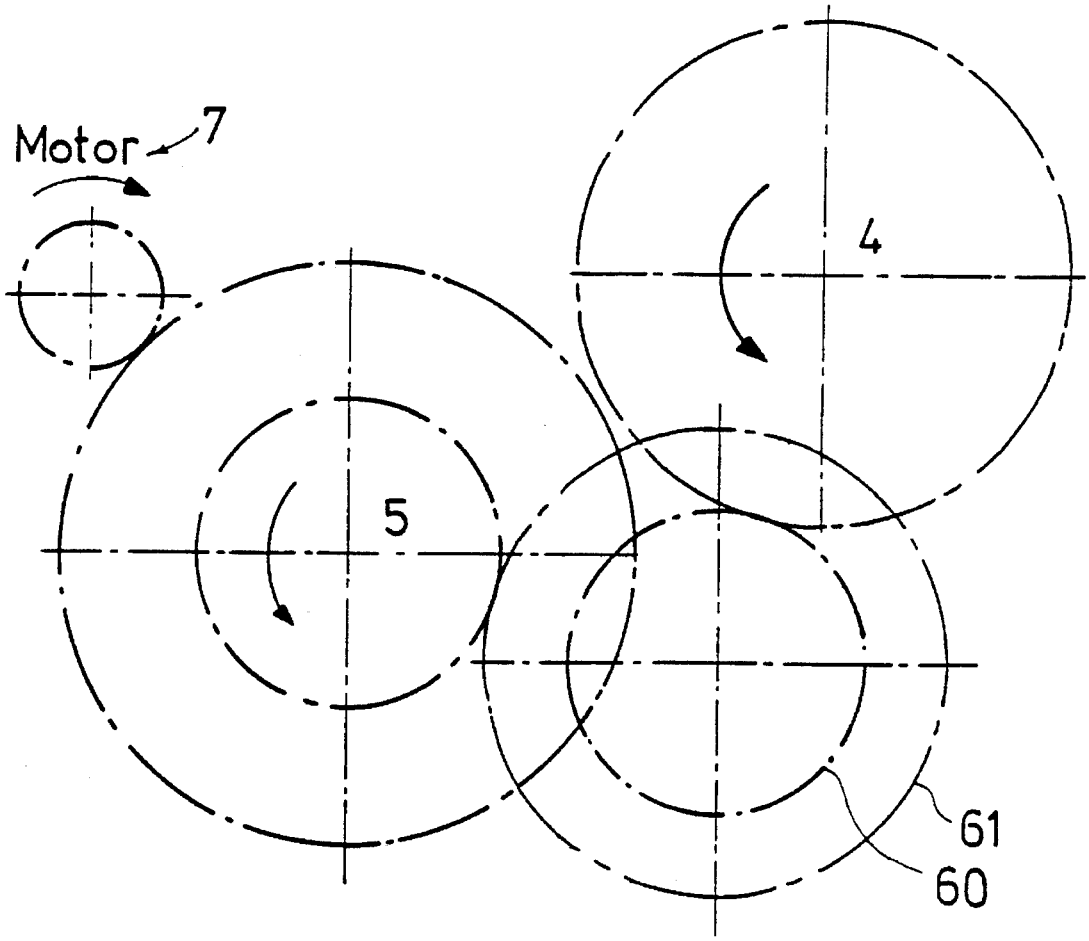
FIG. 5 shows a gear unit for the operation of the feed roll in a schematic manner.

FIG. 5 shows the very simple reduction gear unit with a set of gear wheels for the feed roll 5 and for the distributing roll 4, respectively, and only one set of transmission rollers 60 and 61, respectively. The advantage of this construction consists in that the transmission required for the transmission from the feed roll to the distributing roll is simultaneously the reduction gearing from a drive motor to the feed roll.

Figure 6:
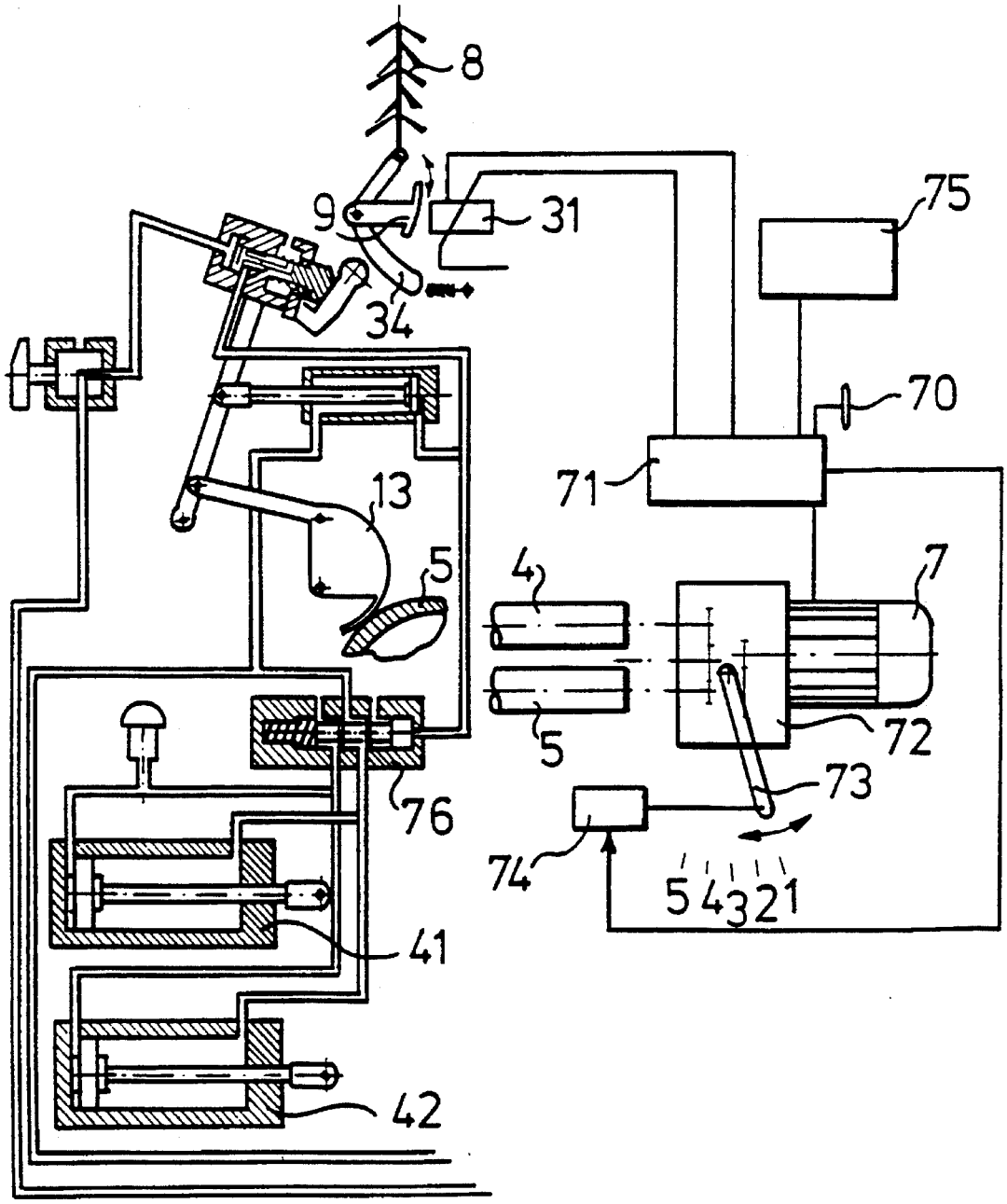
FIG. 6 shows an example for regulating the feed by means of pneumatic regulation of a segment slide and for the control of various speed stages of the feed rolls.

FIG. 6 shows another particularly advantageous construction for a completely self-regulating product feed via an analog signal and the possibility of a pre-adjustment of a feed roll speed stage by means of a motor, possibly by manual input 70 via a control unit 71. A switching lever 73 and automatic adjusting means 74 can be switched to one of the speed stages 1, 2, 3, 4 or 5 via a stage switching gear unit. However, it is also possible to switch the gear unit 72 to the desired stage via computing and storage means 75 and a predetermined program by way of a multiple-digital signal.

In FIG. 6, the digital signal is initiated via the control unit according to external parameters. An analog signal is transmitted to the control unit simultaneously via an analog signal converter by the mechanical signal transmitter 9. In particular, this has the advantage that a corresponding position signal for monitoring tasks is utilized in the computer and various controls can be coordinated.

The actual feed regulation is effected via the type of pneumatic regulation of the metering segment and metering gap 12 known from EP-PS 38 054. The engagement and disengagement is controlled by a digital signal modeled on the pneumatic analog signal and formed by a threshold value control valve 76.

Figure 7:
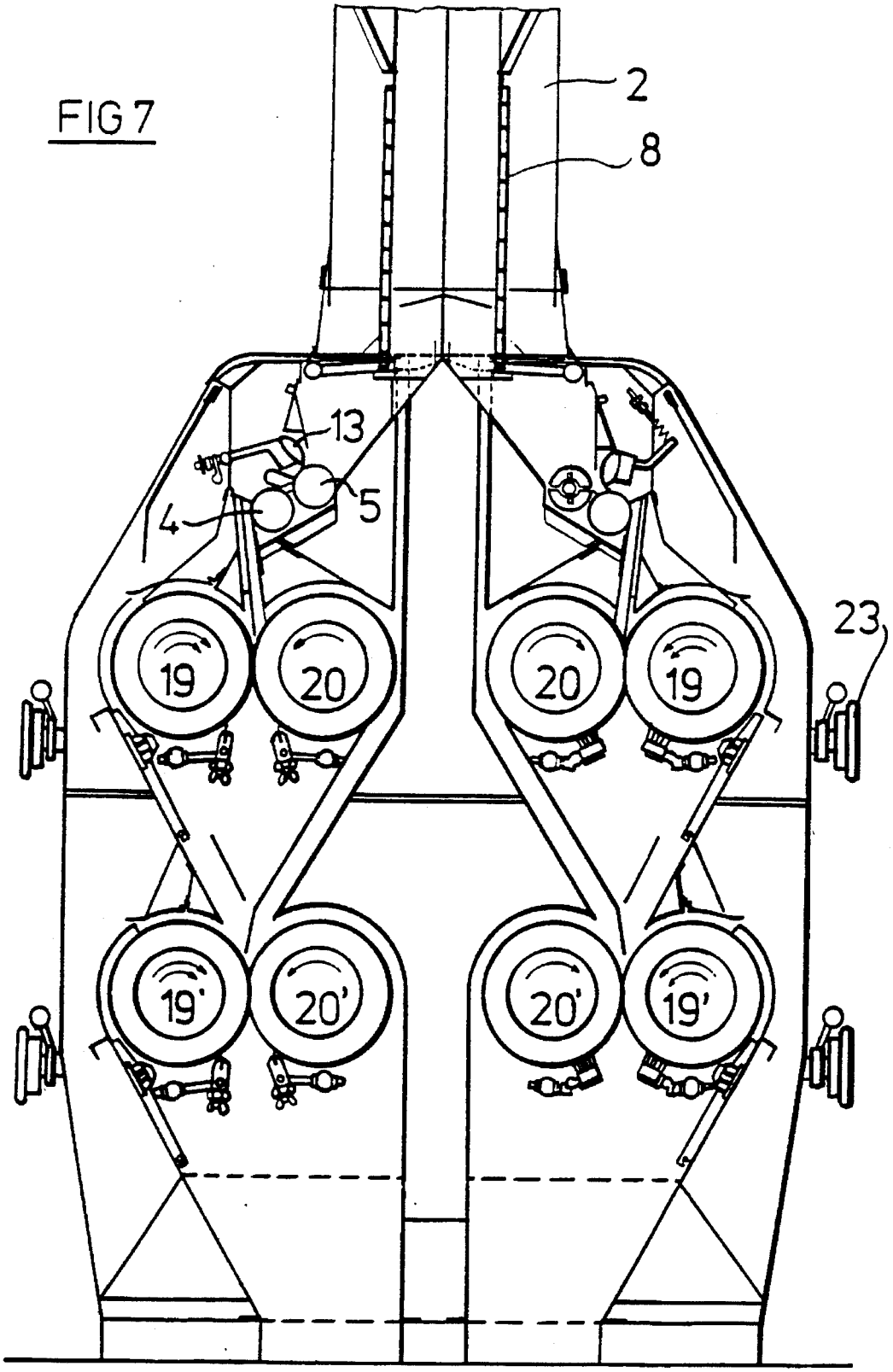
FIG. 7 shows a section through an 8-roll roller mill.

FIG. 7 shows the two halves of an 8-roll milling roller mill. Each sensor, which is constructed in this case as a vertically disposed perforated plate, is associated with one vertical half, i.e. two roll pairs $^{19}/_{20}$, $^{19'}/_{20'}$ arranged one above the other.

We claim:

1. A method for controlling the grinding in a multiple roll milling roller mill, the mill having two pairs of grinding rollers arranged one above the other, a sensor for sensing product feed, a product feed device for regulating product feed to the grinding rollers, and means for engaging and disengaging each pair of grinding rollers, the method comprising the steps of:

generating an analog signal using the sensor, the analog signal being proportional to the product flow in the mill;

regulating the product feed using the analog signal;

generating an independently adjustable digital signal using the sensor; and controlling the means for engaging and disengaging the pairs of grinding rollers using the digital signal.

2. The method according to claim 1, which further comprises the steps of generating a second digital signal, the second digital signal being generated by an independent control unit, and controlling basic adjustments of the product feed.

3. The method of claim 1, wherein the second digital signal is used to control basic adjustments of the product feed as a function of at least one of mill output and product quality.

4. The method according to claim 1, wherein the product feed device further includes a plurality of rolls to regulate the product feed to the grinding rollers, and wherein the step of regulating the product feed further includes the step of using the analog signal to regulate the speed of the plurality of rolls.

5. The method according to claim 1, wherein the product feed device further includes a product feed segment to regulate the product feed to the two pairs of grinding rollers, and wherein the step of regulating the product feed further includes the step of using the analog signal to regulate the position of the product feed segment.

6. A milling roller mill comprising:

a feed cylinder;

a sensor in the feed cylinder for sensing product flow therein;

a product feed device;

means responsive to the sensor for regulating the product flow through the product feed device;

two pairs of grinding rollers arranged one above the other;

controlling means for engaging and disengaging the two pairs of rollers; and means responsive to the sensor for generating a digital signal for operating the controlling means.

7. The milling roller mill according to claim 6, wherein the sensor is a mechanically movable perforated plate extending generally in the direction of the product flow, the perforated plate being supported by a spring.

8. The roller mill according to claim 6, wherein a contact switch of an electric valve is associated with the controlling means.

9. The milling roller mill according to claim 6 further comprising means responsive to the sensor for generating an analog signal proportional to the product feed flow.

10. The roller mill according to claim 9, wherein the sensor is mechanically movable and wherein a proximity switch is used to convert a mechanical signal from the mechanically movable sensor into the analog signal.

11. The roller mill according to claim 9, wherein a voltage transformer unit and a current transformer unit are directly associated with the analog signal generating means.

12. The milling roller mill according to claim 9, wherein the sensor is mechanically movable and wherein the means for generating the digital signal and the means for generating the analog signal each include contact elements movable by the mechanically movable sensor.

13. The roller mill according to claim 12, wherein the contact elements are associated with the mechanically movable sensor as signal transmitters for the analog signal and for the digital signal.

14. The roller mill according to claim 13, wherein the contact elements are located distant the mechanical movable sensor.

15. The milling roller mill according to claim 9, wherein the product feed device has at least one roll with adjustable drive means and a product feed segment.

16. The roller mill according to claim 15, wherein the product feed device has a product feed segment and the analog signal is associated with the regulation of the product feed segment, and wherein a drive motor, and an adjusting device and a control unit for selecting different speed stages of the at least one roll are associated with the at least one roll.

17. The milling roller mill according to claim 15, wherein the product feed device has a plurality of rolls with adjustable drive means and the analog signal is used to control the adjustable drive means.

18. The milling roller mill according to claim 15, wherein the product feed device has a product feed segment and the analog signal is used to control to the product feed segment.

19. The roller mill according to claim 15, wherein a frequency converter unit for regulating the at least one roll is associated with the roller mill at a distance thereto.

20. The roller mill according to claim 15, wherein the product feed device has a plurality of rolls with adjustable drive means, the plurality of rolls includes a feed roll and a distributing roll arranged parallel to the feed roll, and the adjustable drive means comprises a drive motor rotatably attached to a rotational direction reversing gear unit.

21. The roller mill according to claim 20, wherein the rotational direction reversing gear unit has a reduction gear ratio of about 1:10.

22. The roller mill according to claim 20, wherein the reversing gear unit includes at least three toothed-wheel pairs.

* * * * *